US007546645B2

(12) United States Patent
Goodhand et al.

(10) Patent No.: US 7,546,645 B2
(45) Date of Patent: Jun. 16, 2009

(54) VISOR HOLDER FOR A HEAD PROTECTIVE HELMET

(75) Inventors: Stephen Goodhand, Kirkland (CA); André Desjardins, Dorval (CA); David Rudd, Vaudreuil-Dorion (CA); Ricky Paquette, Montreal (CA)

(73) Assignee: Mission Itech Hockey Ltd., Kirkland, Quebec (CA)

( * ) Notice: Subject to any disclaimer, the term of this patent is extended or adjusted under 35 U.S.C. 154(b) by 56 days.

(21) Appl. No.: 11/705,540

(22) Filed: Feb. 13, 2007

(65) Prior Publication Data

US 2008/0189836 A1 Aug. 14, 2008

(30) Foreign Application Priority Data

Dec. 6, 2006 (CA) ..... 2570095

(51) Int. Cl.
*A42B 1/08* (2006.01)

(52) U.S. Cl. ..... 2/424; 2/425; 2/15

(58) Field of Classification Search ..... 2/424, 2/410, 411, 421, 422, 425, 9, 15, 10
See application file for complete search history.

(56) References Cited

U.S. PATENT DOCUMENTS 3,050,736 A * 8/1962 Malcom, Jr. ..... 2/9
4,462,119 A * 7/1984 Rudd ..... 2/424
4,587,677 A * 5/1986 Clement ..... 2/424
5,263,204 A * 11/1993 Butsch ..... 2/424
5,412,814 A * 5/1995 Pernicka et al. ..... 2/424
5,483,699 A * 1/1996 Pernicka et al. ..... 2/9
D373,223 S * 8/1996 Pernicka et al. ..... D29/110
5,815,848 A * 10/1998 Jarvis ..... 2/424
5,956,776 A * 9/1999 Chartrand ..... 2/420
5,966,738 A * 10/1999 Wang Lee ..... 2/10
6,212,689 B1 * 4/2001 Lee ..... 2/424
6,237,161 B1 * 5/2001 Lee ..... 2/414
6,301,719 B1 10/2001 Goodhand et al.
6,807,679 B1 * 10/2004 Wang-Lee ..... 2/10
6,934,972 B2 * 8/2005 Desjardins et al. ..... 2/425
6,966,075 B2 * 11/2005 Racine ..... 2/425
7,003,802 B2 * 2/2006 Broersma ..... 2/9
7,181,777 B2 * 2/2007 Choi et al. ..... 2/424
7,320,144 B2 * 1/2008 Katz et al. ..... 2/9

* cited by examiner

*Primary Examiner*—Danny Worrell

(57) ABSTRACT

A visor holder for a head protective helmet whereby to secure a clear plastic visor thereto. The holder is a single molded plastic piece which has a narrow frontal curved portion and opposed depending rear visor attachment portions. The visor holder is adapted to be secured to a helmet and side mounting brackets are provided for the adjustable attachment of the depending rear visor attachment portions of the holder to a helmet. The holder also has vent holes in a frontal curved portion thereof for moisture release and air exchange.

29 Claims, 4 Drawing Sheets

VISOR HOLDER FOR A HEAD PROTECTIVE HELMET

TECHNICAL FIELD

The present invention relates to a visor holder for attaching a clear plastic visor to helmets of different sizes and shapes.

BACKGROUND ART

In our U.S. Pat. No. 6,301,719, there is shown an attachment system whereby to secure a clear plastic visor to a wire grid face protector of a helmet. The clear plastic lens or visor is secured to a connector which is attached to the wire grid face protector. Accordingly, a wire grid face protector is required to mount the lens and as such, it has limited applications and adaptations in that it can be used with specific helmets having a particular wire grid face protector which is not easily securable to helmets of different sizes and shapes. Often, there is no need to provide a wire grid face protector in certain sports as these are often a nuisance. These structures are also not aesthetically pleasing.

SUMMARY OF INVENTION

A feature of the present invention is to provide a visor holder which is adjustable and capable of securing a clear plastic lens to helmets of different sizes and shapes.

Another feature of the present invention is to provide a visor holder which is aesthetically pleasing, robust, which provides ventilation to the lens or visor when attached thereto.

Another feature of the present invention is to provide a visor holder which is easy to secure to a helmet and which provides ease of attachment of a protective visor thereto.

According to the above features, from a broad aspect, the present invention provides a visor holder for a head protective helmet wherein the holder is comprised of a single molded piece having a narrow frontal curved portion and opposed depending rear visor attachment portions. Securement means is provided for immovably securing the holder about the peripheral forehead and temple area of a helmet. The securement means has a pair of side mounting brackets adapted to be secured to a helmet adjacent the temple area on opposed sides thereof for adjustable interconnection with interlocking means on an inner surface of the depending rear visor attachment portions to adapt the visor holder to helmets of different sizes and shapes. Attachment means is formed integral in the opposed depending rear visor attachment portions for releasable connection of a visor thereto.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
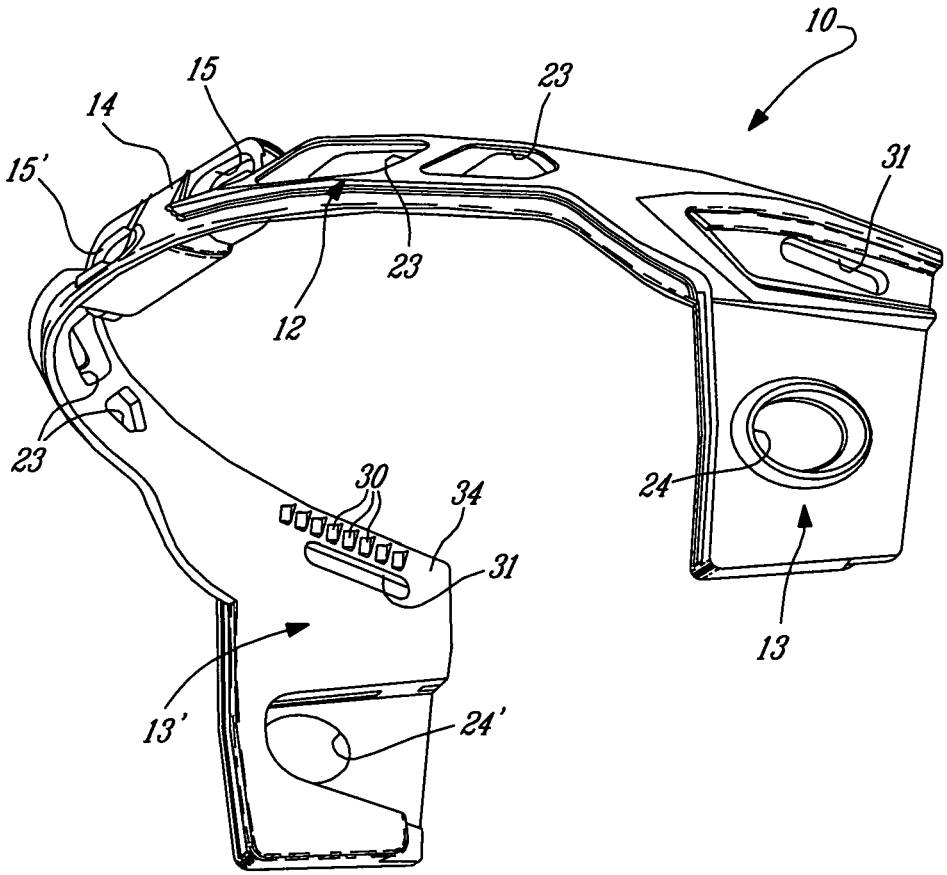
FIG. 1 is a perspective bottom view of the visor holder of the present invention.
Figure 2:
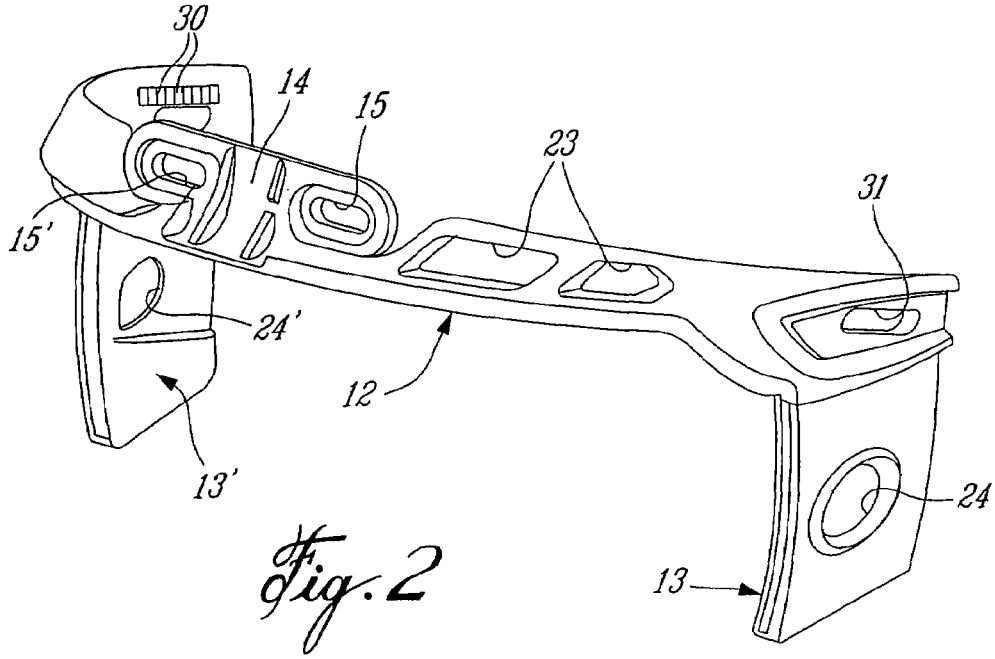
FIG. 2 is a top perspective view of the visor holder of the present invention.
Figure 3:
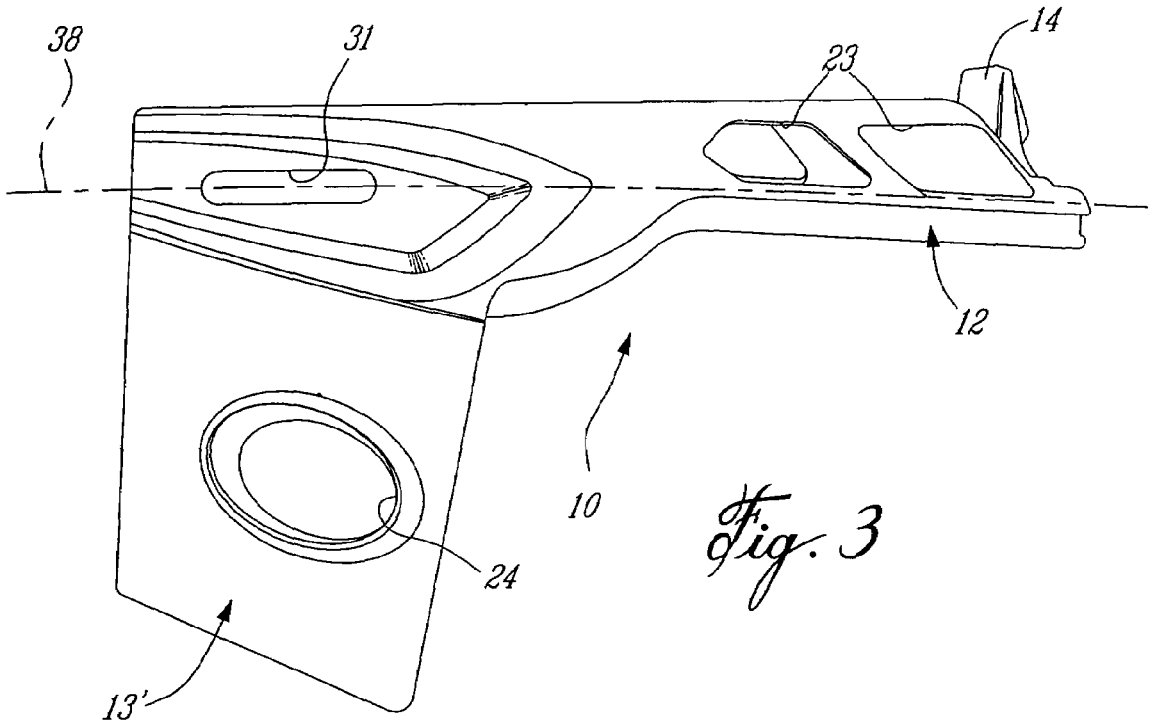
FIG. 3 is a side view of the visor holder of the present invention.
Figure 5:
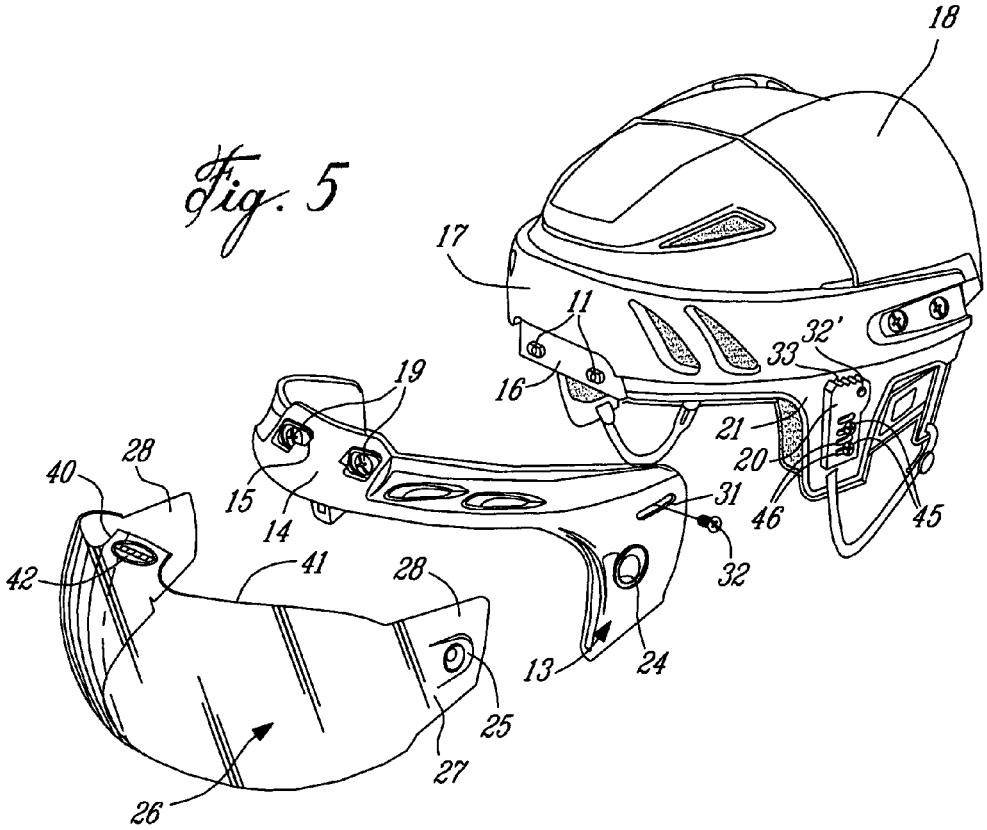
FIG. 5 is a perspective view showing the visor holder secured to a helmet with the clear plastic visor secured to the holder.

Referring now to the drawings and more particularly to FIGS. 1 to 3, there is shown generally at 10 the visor holder of the present invention. It is comprised of the single molded piece formed by injection molded polycarbonate plastics or other suitable material. The single molded piece defines a narrow frontal curved portion 12 and opposed depending rear visor attachment portions 13 and 13'. A connector 14 is formed integral in the central area of the narrow frontal curved portion 12 and provided with two elongated slots 15 and 15' whereby to connect to existing threaded post bolts 11 that are inserted through elongated slots in the helmet and project in the frontal peripheral portion 16 of the frontal area 17 of a helmet 18, as illustrated in FIG. 5. The slots 15 and 15' of the connector 14 provide for adjustable securement to the existing threaded post bolts 11, as shown in FIG. 5. Fasteners 19 are used for the securement.

Figure 4:
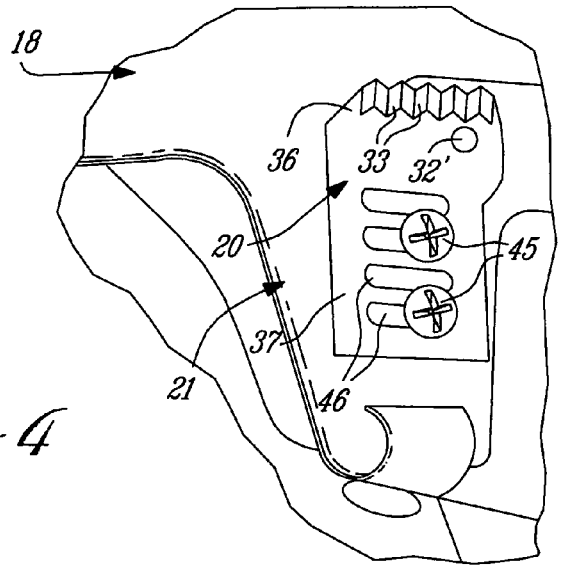
FIG. 4 is a perspective view of an attachment bracket for securing the visor holder to the temple area on opposed side of a helmet.

As shown in FIG. 4, the securement means for attaching the visor holder to a helmet further comprises a pair of side mounting brackets 20 which are adapted to be secured to a helmet adjacent the temple area 21.

The visor holder is further provided with vent means in the form of vent holes 23, see FIG. 2, integrally formed in the narrow frontal curved portion 12 of the holder 10 and disposed above the forehead of the wearer person wearing the helmet. Visor attachment means in the form of holes 24 and 24' are provided respectively in the depending rear visor attachment portions 13 and 13' and are shaped to receive a retention clip 25, formed integral with the clear plastic visor 26, as illustrated in FIG. 5. The visor 26 is shaped whereby to be compressed to fit inside the depending rear visor attachment portions 13 and 13' with the retention clip 25 projecting outwardly from the outer surface 27 of the visor at opposed attachment ends 28. When the clips 25 register with the holes 24 and 24', the clip springs into the attachment holes 24 to secure the visor to the visor holder. To remove the visor, it is only necessary to push in the clips 25 and move the visor forward to remove it.

As shown in FIG. 1, the depending rear visor attachment portions 13 and 13' are provided in the upper part thereof with interlocking means in the form of a plurality of projecting teeth elements 30 which are herein shown as being of saw tooth cross-section. These teeth elements 30 are disposed in series with one another and disposed adjacent an elongated slot 31 through which is received a fastener 32, see FIG. 6, which is engageable with a threaded bore 32' of the associated bracket 20, as shown in FIG. 4, secured to the temple area 21 of the helmet 18. The bracket 20 is also provided with a series of serrated depressions 33 dimensioned to interlock with the series of teeth 30 provided in the inner face 34 of the depending rear visor attachment portions 13 and 13'. One or two of these serrated depressions could be sufficient but preferably a series provides for a more secured connection. Accordingly, the visor holder 10 can be adjustably secured to a variety of helmet sizes and shapes by simply fitting the visor holder with the attachment bracket and securing the attachment bracket 20 to the helmet in the approximate required area as the adjustment can then be made with this adjustable feature of the interlocking teeth. Accordingly, the serrated depressions 33 constitute a securement means. The bracket 20 is also provided with slots 46 to provide adjustable connection over the temple area 21 of the helmet 18 by the use of fasteners 45. There are at least two parallel slots 46 to permit rigid connection and prevent tilting of the bracket.

As shown in FIG. 4, the serrated depressions 33 are disposed along a top edge 36 and formed in the outer face 37 of the bracket 20 and disposed for facial alignment with the toothed elements 30 when the holder is secured to a helmet by the fasteners 32.

As also shown in FIGS. 1 and 3, the series of toothed elements 30 are disposed in substantially parallel alignment with the slot 31 and extends along parallel longitudinal axes projecting in a horizontal plane 38, see FIG. 3, of the narrow frontal curved portion of the holder.

Figure 6:
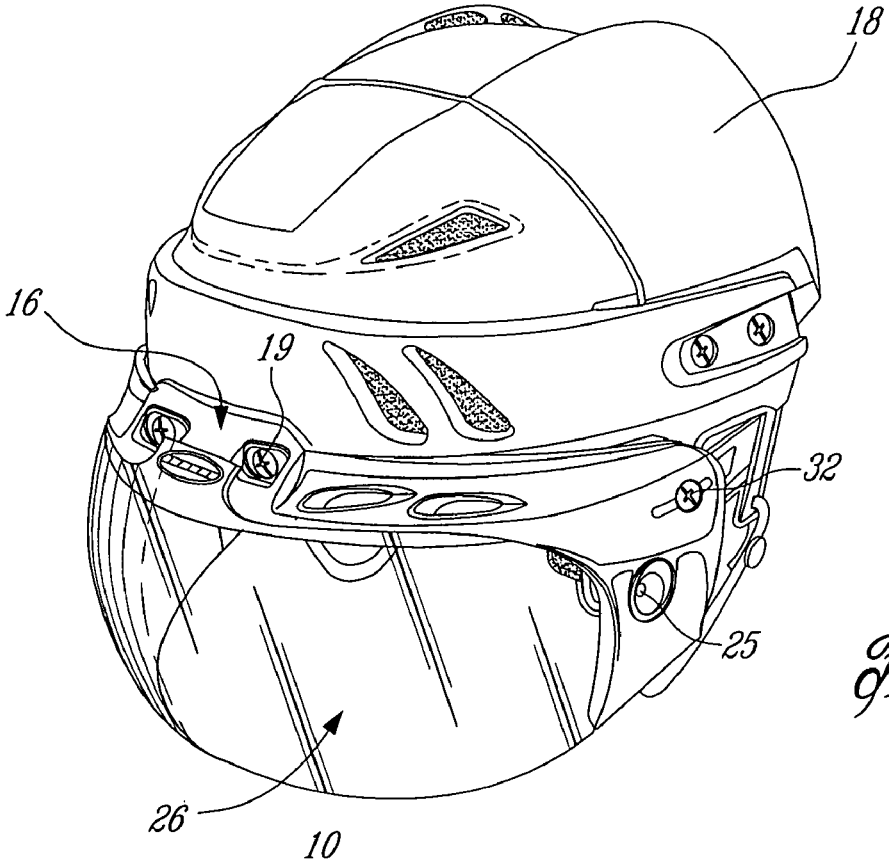
FIG. 6 is a perspective view showing a modification of the clear plastic visor wherein it is provided with different tint tones or a variable tint tone.

As shown in FIGS. 5 and 6, the visor 26 is herein provided with a rearwardly projecting flange 40 extending centrally from a top edge 41 of the visor and extending forwardly of the connector 14. The projecting flange 40 is adapted to receive an insignia, such as shown at 42 thereon and which is visible when worn by a user person, as shown in FIG. 6. It is also an aesthetic feature.

Figure 7:
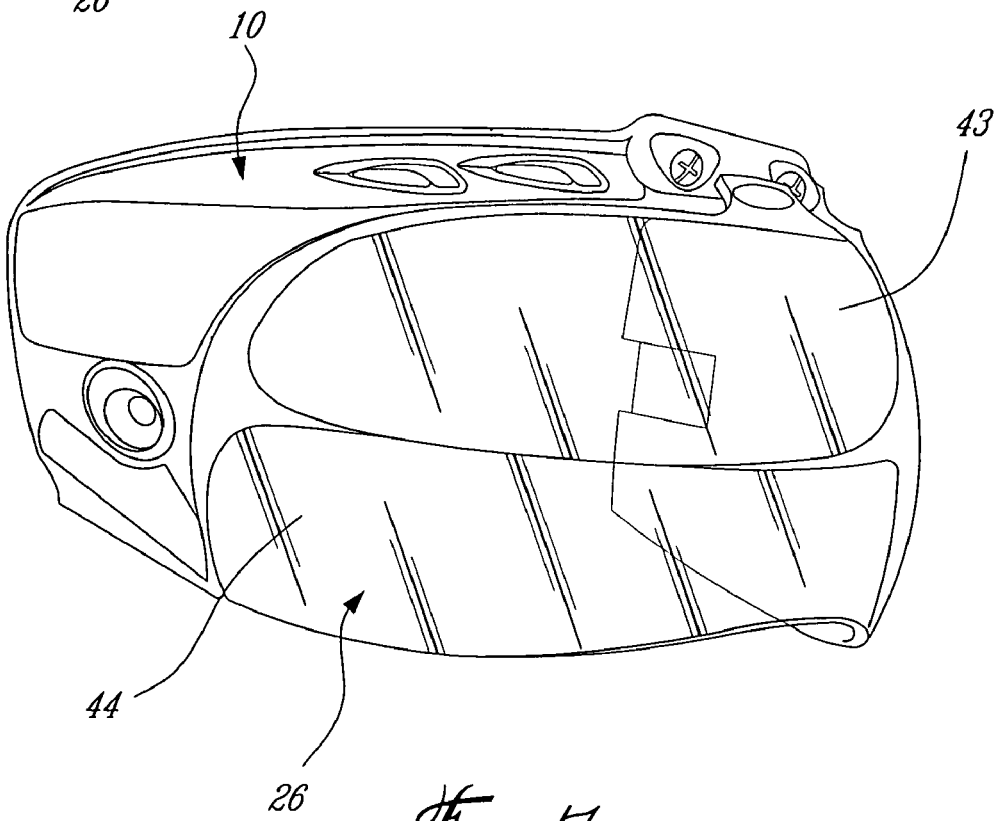
FIG. 7 is a perspective view showing a tinted visor.

As shown in FIG. 7, the clear plastic visor 26 may be tinted in at least a portion thereof, and as herein shown there are two distinct tint tones, namely an upper tint tone portion at 43 and a lower tint tone portion 44 with the tones being of different colors. It is also envisaged that the tone can have a single tint but degraded from dark to clear with the darkest part of the tone being of course, in the upper portion of the lens whereby to provide glare shading.

Accordingly, with the visor holder of the present invention it is possible to adapt clear plastic visors to helmets of different sizes and shapes thereby making it possible to use a common visor or lens on helmets formed by different fabricators.

It is within the ambit of the present invention to cover any obvious modifications of the preferred embodiments described herein, provided such modifications fall within the scope of the appended claims.

The invention claimed is:

1. A visor holder for a head protective helmet, said visor holder comprising a single molded piece having a narrow frontal curved portion and opposed depending rear visor attachment portions, securement means for immovably securing said holder about a peripheral forehead and temple area of a helmet, said securement means having a pair of side mounting brackets adapted to be secured to the helmet adjacent its temple area on opposed sides thereof for adjustable interconnection with interlocking means on an inner face of said depending rear visor attachment portions to adapt said visor holder to helmets of different sizes and shapes, and attachment means formed integral in said opposed depending rear visor attachment portions for releasable connection of a visor thereto, wherein said attachment means is a hole extending through each said depending rear visor attachment portions and shaped to receive a retention clip formed integral with the visor and projecting outwardly from an outer surface of the visor at opposed attachment ends thereof for removably securing the visor to said visor holder.

2. A visor holder as defined in claim 1 wherein said securement means further comprises a connector formed in a central area of said frontal curved portion and adapted for adjustable securement to existing attachment holes in the peripheral forehead area of the helmet.

3. A visor holder as defined in claim 1 wherein said interlocking means comprises a plurality of toothed elements disposed in series with one another in relation to a connecting slot, wherein each of said mounting brackets has arresting means and a threaded bore therein for receiving a fastener extending through said connecting slot, and wherein said toothed elements engage with said arresting means of said mounting brackets.

4. A visor holder as defined in claim 3 wherein said arresting means are serrated depressions formed integral on an outer surface of each mounting brackets and engageable by said toothed elements.

5. A visor holder as defined in claim 4 wherein said serrated depressions are aligned for facial alignment with said toothed elements when said visor holder is secured to the helmet by each fastener extending through said connecting slot of each said depending rear visor attachment portions.

6. A visor holder as defined in claim 3 wherein each of said mounting brackets has at least two parallel slots for adjustably connecting said mounting bracket to the helmet.

7. A visor holder as defined in claim 5 wherein serrated depressions and said toothed elements are of saw tooth cross-section.

8. A visor holder as defined in claim 3 wherein said toothed elements are disposed in substantially parallel alignment with said connecting slot and extend along parallel longitudinal axis projecting in a horizontal plane of said narrow frontal curved portion.

9. A visor holder as defined in claim 1 further comprising vent means in said frontal curved portion for moisture release and air exchange.

10. A visor holder as defined in claim 9 wherein said vent means are vent holes integrally formed in said narrow frontal curved portions and disposed above the forehead of a person wearing the helmet.

11. A visor holder as defined in claim 1 wherein said visor holder is injected molded from polycarbonate plastics material.

12. A visor holder for a head protective helmet, said visor holder comprising a single molded piece having a narrow frontal curved portion and opposed depending rear visor attachment portions, each having a connecting slot, securement means for immovably securing said visor holder about a peripheral forehead and temple area of a helmet, said securement means having a pair of side mounting brackets adapted to be secured to a helmet adjacent said temple area on opposed sides thereof for adjustable interconnection with interlocking means on an inner face of said depending rear visor attachment portions to adapt said visor holder to helmets of different sizes and shapes, and attachment means formed integral in said opposed depending rear visor attachment portions for releasable connection of a visor thereto; wherein said interlocking means comprises a plurality of toothed elements disposed in series with one another in relation to said connecting slot; wherein each of said mounting brackets has arresting means and a threaded bore for receiving a fastener extending through said connecting slot; and wherein said toothed elements of said depending rear visor attachment portions are adapted to engage with said arresting means of said mounting brackets.

13. A visor holder as defined in claim 12 wherein said arresting means are serrated depression formed integral on an outer surface of each mounting bracket.

14. A visor holder as defined in claim 12 wherein said toothed elements are disposed in substantially parallel alignment with said connecting slot and extend along parallel longitudinal axis projecting in a horizontal plane of said narrow frontal curved portion.

15. A visor holder as defined in claim 12 further comprising vent means in said frontal curved portion for moisture release and air exchange.

16. A visor holder as defined in claim 15 wherein said vent means are vent holes integrally formed in said narrow frontal curved portions and disposed above the forehead of a person wearing the helmet.

17. A visor holder as defined in claim 12 wherein said visor holder is injected molded from polycarbonate plastics material.

18. A visor holder as defined in claim 12 wherein said securement means further comprises a connector formed in a central area of said frontal curved portion and adapted for adjustable securement to existing attachment holes provided in the peripheral forehead area of the helmet.

19. A combination comprising a visor holder and a pair of side mounting brackets for a head protective helmet having a peripheral forehead and temple area, said visor holder having a narrow frontal curved portion and opposed depending rear visor attachment portions, each of said rear visor attachment portion having interlocking means provided on its inner face, a connecting slot, and attachment means for releasable connection of a visor thereto, and wherein each mounting bracket has two parallel slots for adjustably connecting said mounting bracket about the temple area of the helmet and has arresting means and a threaded bore for receiving a fastener extending through said connecting slot of each of said rear visor attachment portions for securing said visor holder to helmets of different sizes and shapes.

20. A combination as defined in claim 19 wherein said attachment means is a hole extending through each said depending rear visor attachment portions and shaped to received a retention clip formed integral with the visor and projecting outwardly from an outer surface of the visor at opposed attachment ends thereof for removably securing the visor to said visor holder.

21. A combination as defined in claim 20 wherein said interlocking means comprises a plurality of toothed elements disposed in series with one another in relation to said connecting slot and wherein said toothed elements engage with said arresting means of each mounting bracket.

22. A combination as defined in claim 21 wherein said arresting means are a plurality of said serrated depressions formed integral on an outer surface of each mounting bracket and being aligned for facial alignment with said toothed elements when said visor holder is secured to the helmet by each fastener extending through said connecting slot of each of said depending rear visor attachment portions.

23. A combination as defined in claim 22 wherein said frontal curved portion of said visor holder has two elongated slots and wherein, in use, two fasteners extend through said elongated slots for adjustable securement to existing attachment holes provided in the peripheral forehead area of the helmet.

24. A combination comprising a visor holder, a pair of side mounting brackets and a visor for a head protective helmet having a peripheral forehead and temple area, said visor having retention clips projecting outwardly from its outer surface at opposed attachment ends thereof for removably securing the visor to said visor holder, said visor holder having a narrow frontal curved portion and opposed depending rear visor attachment portions, each of said rear visor attachment portion having interlocking means provided on its inner face, a connecting slot and a hole shaped to receive said retention clip, and wherein each mounting bracket has two parallel slots for adjustably connecting said mounting bracket about the temple area of the helmet and has arresting means and a threaded bore for receiving a fastener extending through said connecting slot of each of said rear visor attachment portions for securing said visor holder to helmets of different sizes and shapes.

25. A combination as defined in claim 24 wherein said interlocking means comprises a plurality of toothed elements disposed in series with one another in relation to said connecting slot and wherein said toothed elements engage with said arresting means of each mounting bracket.

26. A combination as defined in claim 24 wherein said arresting means are a plurality of serrated depressions formed integral on an outer surface of each mounting bracket and being aligned for facial alignment with said toothed elements when said visor holder is secured to the helmet by each fastener extending through said connecting slot of each of said depending rear visor attachment portions.

27. A combination as defined in claim 24 wherein said frontal curved portion of said visor holder has two elongated slots and wherein, in use, two fasteners extend through said elongated slots for adjustable securement to existing attachment holes provided in the peripheral forehead area of the helmet.

28. A combination as defined in claim 24 wherein said visor has a rearwardly projecting flange extending centrally from a top edge thereof and extending forwardly of said frontal curved portion of said visor holder, said projecting flange being adapted to receive an insignia thereon.

29. A combination as defined in claim 24 wherein said visor is tinted in at least a portion thereof and with at least one tint tone or a variable tint tone.

* * * * *